US006443358B1

(12) United States Patent
Schilling

(10) Patent No.: US 6,443,358 B1
(45) Date of Patent: Sep. 3, 2002

(54) STACKABLE CONTAINER

(75) Inventor: Johan H. Schilling, Ontario, CA (US)

(73) Assignee: Fruit Growers Supply Company, Ontario, CA (US)

( * ) Notice: Subject to any disclaimer, the term of this patent is extended or adjusted under 35 U.S.C. 154(b) by 0 days.

(21) Appl. No.: 09/931,219

(22) Filed: Aug. 14, 2001

(51) Int. Cl.[7] ..... B65D 21/032

(52) U.S. Cl. ..... 229/174; 206/509; 229/174; 229/915

(58) Field of Search ..... 229/174, 915, 229/918, 919; 206/509, 511, 512

(56) References Cited

U.S. PATENT DOCUMENTS 3,734,392 A * 5/1973 Clark ..... 229/174
3,946,934 A * 3/1976 Chaffers ..... 206/509
4,134,533 A 1/1979 Heavner
4,770,339 A 9/1988 Weimer
5,002,224 A 3/1991 Muise
5,294,044 A 3/1994 Clark
5,429,296 A 7/1995 Southwell et al.
5,452,848 A 9/1995 Gimeno
5,535,941 A 7/1996 Garza
5,649,663 A 7/1997 Pestow, Jr.
5,860,590 A 1/1999 Blomfield et al.
6,131,805 A * 10/2000 Gasior ..... 229/174
6,138,904 A * 10/2000 Baird et al. ..... 229/915
6,270,009 B1 * 8/2001 Heeren ..... 229/919

FOREIGN PATENT DOCUMENTS

FR 2682936 A1 * 4/1993 ..... 229/174

* cited by examiner

*Primary Examiner*—Gary E. Elkins
(74) *Attorney, Agent, or Firm*—Sheppard, Mullin, Richter & Hampton LLP; James R. Brueggemann

(57) ABSTRACT

A stackable container formed from a single-piece blank pre-cut and pre-scored with an improved design directed at providing material cost savings while achieving stacking stability and related benefits. The container includes a base with two sets of opposing walls. Each wall of the first set incorporates a first panel and a second panel. The first panel is foldably attached at a lower edge to the base and is hinged at an upper edge to the second panel, wherein the upper edge also defines a shoulder. Each wall of the first set further incorporates at least one stacking tab that extends beyond the shoulder. The stacking tabs are two-ply and have a tab base and a sequencing panel. The tab base extend from the first panel and is foldably attached to the sequencing panel, wherein the tab base and the sequencing panel are formed from material cut from the second panel, thereby providing the benefits of two-ply stacking tabs and two-ply walls without expanding size requirements of the blank.

18 Claims, 2 Drawing Sheets

STACKABLE CONTAINER

BACKGROUND OF THE INVENTION

This invention relates to stackable containers, and more particularly, stackable containers formed from pre-cut and pre-scored blanks.

A blank is formed by cutting and scoring a sheet of corrugated paperboard or a similar material, i.e., a starting sheet, with a predetermined pattern to enable the blank to be folded to form a container. Typically, containers utilized in the storage, shipping, and display of produce, nuts, fruit, and the like are formed from blanks. Due to the nature of use, it is advantageous for such containers to be securely stackable, and to that end, they are commonly provided with two-ply stacking tabs. Furthermore, the containers are typically required to meet particular size and overall strength requirements as related to usage with specific products, e.g., industry standard orange containers are typically sized 22"× 16"×8"(length × width × depth) using a 275 pound C-flut board grade for five-down footprint configurations. In addition to the type of material used for the starting sheet, the design of the container, as predicated by the blank's pattern, is also a significant contributor to the container's strength attributes and stackability.

The blank's pattern also dictates the size of the starting sheet required to create the blank. Identically sized containers can require starting sheets of varying sizes chiefly due to the blank's pattern, e.g., designs implementing two-ply stacking tabs can require larger starting sheets than would otherwise be required. Material usage is a significant contributor to the overall cost of such containers. Even small decreases in the size requirements of the starting sheet, when carried over many containers, can generate considerable cost savings. Thus, it is desirable to have containers that minimize the use of material without sacrificing strength and durability, and it should be appreciated there is a need for an improved container which satisfies customers requirements while improving cost-effectiveness.

SUMMARY OF THE INVENTION

The present invention is embodied in a stackable container formed from a single blank pre-cut and pre-scored with an improved design in which, once assembled, the container has enhanced stacking and strength attributes. Moreover, the improved design is such that more efficient use of the material is made. More particularly, the container includes a base with two sets of opposing walls. Each wall of the first set incorporates a first panel and a second panel. The first panel is foldably attached at a lower edge to the base and is hinged at an upper edge to the second panel, wherein the upper edge also defines a shoulder. Each wall of the first set further incorporates at least one stacking tab that extends beyond the shoulder. The stacking tabs have a tab base and a sequencing panel. The tab base extend from the first panel and is foldably attached to the sequencing panel, wherein the tab base and the sequencing panel are formed from material cut from the second panel.

In more detailed features of the invention, the first set of opposing walls can alternatively be attached to either opposing side edges or opposing end edges of the base. Additionally, the second panel can be hinged to the first panel by a hinge joint and the first panel can be foldably attached to the base by a single score line.

Also, each wall of the second set of opposing walls can incorporate 1) a outer end panel, 2) two center flaps, and 3) two inner flaps. Each outer end panel is foldably attached at a lower edge to the base. The center flaps are each foldably attached to side edges of the first panels. Furthermore, the inner flaps are each foldably attached to one of the opposing side edges of the second panels.

Other features and advantages of the present invention will become apparent from the following description of the preferred embodiment, taken in conjunction with the accompanying drawings, which illustrate, by way of example, the principles of the invention.

DESCRIPTION OF THE PREFERRED EMBODIMENTS

Figure 1:
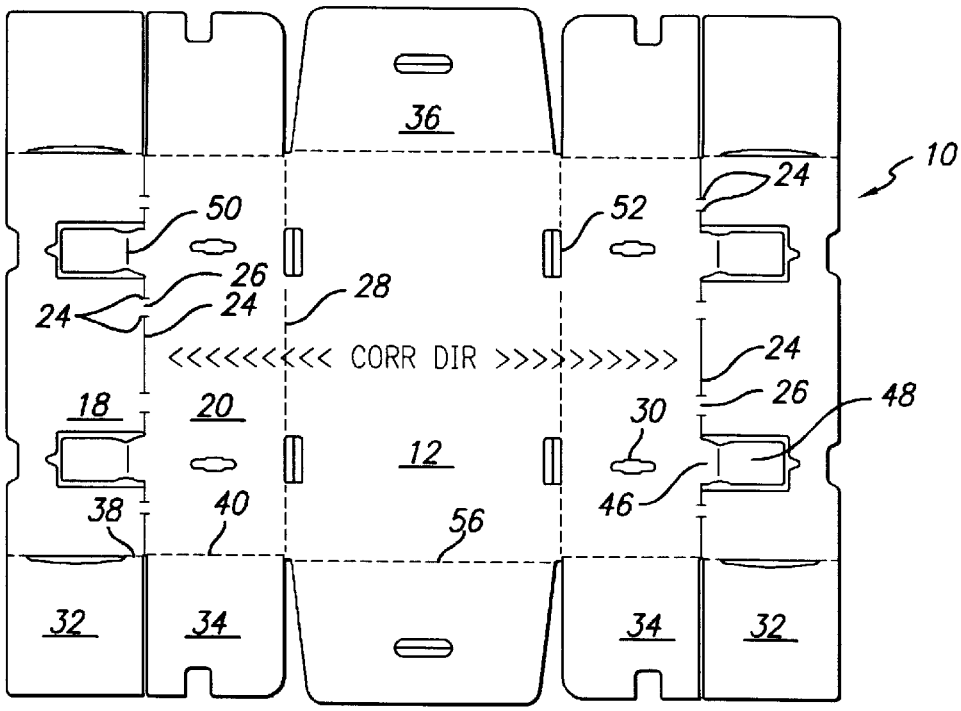
FIG. 1 is a planar view of a pre-cut and pre-scored corrugated paperboard blank, from which the preferred embodiment of a container in accordance with this invention is formed.
Figure 4:
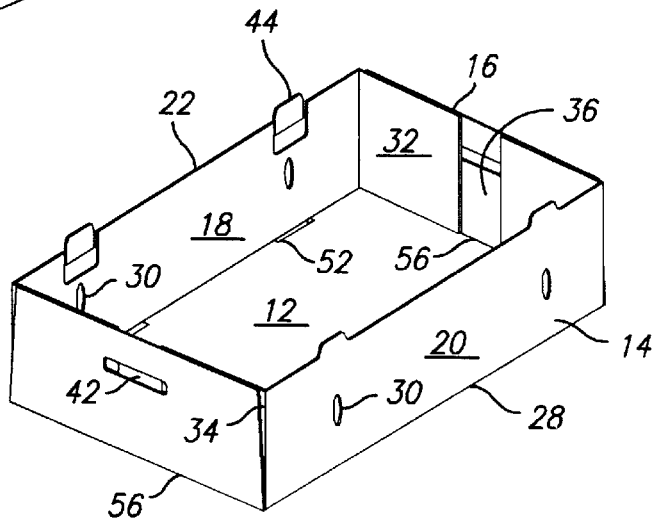
FIG. 4 is an elevated perspective view of an assembled container made from the blank of FIG. 1.

As shown in the exemplary drawings, the present invention is embodied in a stackable container formed from a single-piece blank 10 pre-cut and pre-scored with an improved design. Shown in FIG. 1 is a blank 10, formed from corrugated paperboard from which a stackable container of the preferred embodiment of this invention is assembled. Preferably, the material used is corrugated paperboard, however, other materials which exhibit like characteristics may be used. A sheet of corrugated paperboard is cut and scored as indicated, with solid lines indicating cuts and dashed lines indicating scores, also known as bend or fold lines, to form the blank. The blank has a rectangular base 12 and, once configured, the base is bordered by side walls 14 and end walls 16 (FIG. 4). The paperboard is oriented for cutting and scoring such that, once constructed, the corrugation lines within the side walls run perpendicular to the base to aid in stacking strength.

Figure 3:
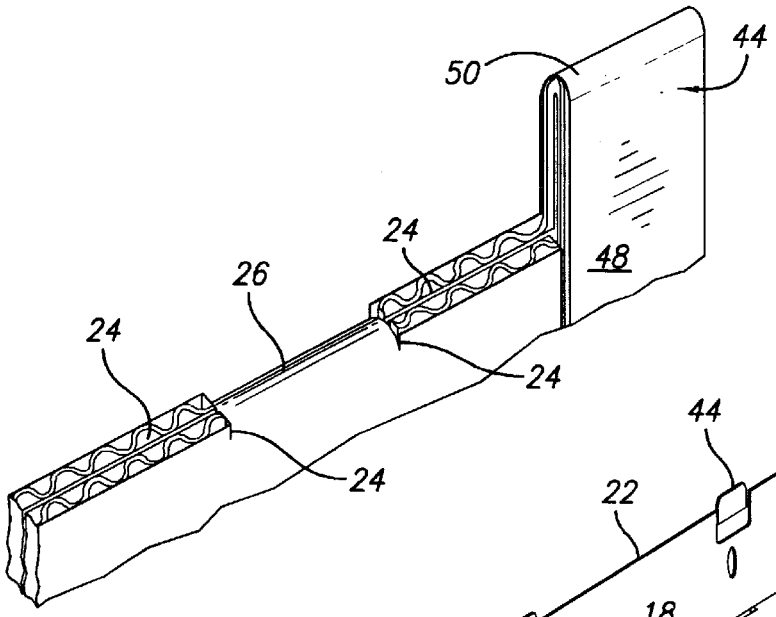
FIG. 3 is an elevated perspective view of a hinge joint of a side wall of a container made from the blank of FIG. 1.

The side walls 14 are two-ply, each formed by an inner side panel 18 and an outer side panel 20 folded about a shoulder joint 22. The shoulder joint is formed by utilizing cut lines 24 and shoulder hinges 26. As best depicted in FIG. 3, the shoulder joints beneficially enable the inner side panels to be folded over 180 degrees to its fully assembled position without the need of double score lines, while maintaining stacking strength and durability. Preferably, each shoulder joint comprises six spaced shoulder hinges, however, it is readily apparent that different number of hinges can be used. The outer side panels are separated from the base 12 by score lines 28. The outer side panels also define vents 30 which aid in the preservation of goods stored in the container. Once assembled, the outer and inner side panels define outer and inner surfaces of the side walls, respectively.

Figure 2:
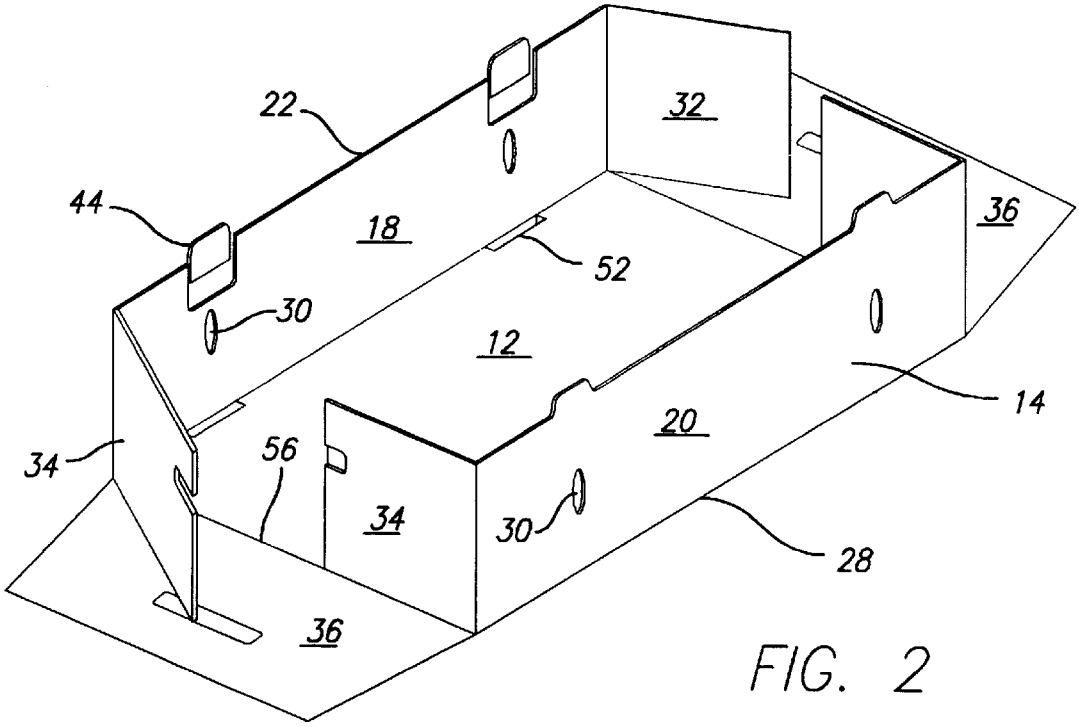
FIG. 2 is an elevated perspective view of a partially assembled container made from the blank of FIG. 1.

With reference to FIG. 2, partial assembly of the end walls 16 are shown. The end walls are three-ply, each formed by folding and securing two inner end flaps 32, two center end flaps 34, and an end panel 36 together by means commonly known in the art, e.g., staples, glue, tabs and slots, or tape.

Once assembled, the corrugation lines within the inner and center end flaps run perpendicular to the base 12, whereas the corrugation lines of the end panel run parallel to the base. The inner end flaps are separated from the inner side panels 18 by score lines 38. The center end flaps are separated from the outer side panels 16 by score lines 40. Once assembled, the end walls define handles 42, which aid in the transportation of the container.

Depicted in FIG. 2, extending above shoulder joint 22, are stacking tabs 44. The stacking tabs of a first container work cooperatively with stacking slots 52 of a second container to facilitate stacking of the containers. Beneficially, stacking tabs are two-ply to enhance stacking stability. Each stacking tab is formed by a tab base 46 and a sequencing panel 48 foldably joined at a crown score 50, thereby providing two-ply thickness and protecting against fraying. The tab bases rigidly project from the outer side panels 20. As evident from FIG. 1, the tab bases and sequencing panels are cut out from material which would otherwise be part of the inner side panels. Thus, the overall length of the blank 10 is not influenced by the inclusion of the stacking tabs to the container design. Rather, the length of the blank is the sum of the width of base 12 and four times the width of a side panel and scoring allowances. Thus, the present invention advantageously provides the benefits of stacking tabs without additional material costs. Also, in the present embodiment, four stacking tabs offset from the end wall (FIG. 2) are shown, however, a varying numbers of stacking tabs are contemplated. Stacking slots 52 (FIG. 1), defined by base 12, are offset an equal distance from the end wall as the stacking tabs.

Figure 5:
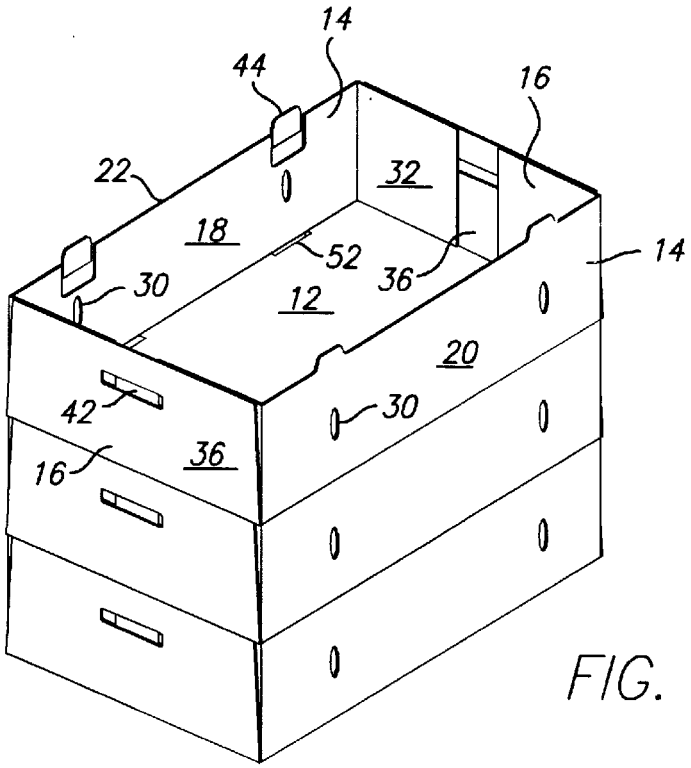
FIG. 5 is an elevated perspective view of three assembled containers like the container depicted in FIG. 4, illustrating the manner in which the containers may be stacked.

In forming the container from blank 10, the side walls 14 are formed by folding the inner side panels 180 degrees about shoulder joints 22 and then folding the outer side panels 90 degrees about score lines 28. Thereafter, the inner and center end flaps, 32 and 34, are folded in unison 90 degrees about score lines 36 and 38. The outer end panels 34 are folded 90 degrees about score line 56 and thereafter the end panels are secured to the inner and center end flaps. The stacking tabs are configured by folding the sequencing panel 180 degrees about the crown score 50 and secured in place by means commonly known in the art, e.g., staples, glue, tabs and slots, or tape. Alternatively, the sequencing panel can be folded about the crown score and left unsecured. In this configuration the sequencing panel will remain spaced apart from the stacking tab in a wedge-like configuration, thereby beneficially aiding in stacking securement. Upon inspection of FIG. 5 it will be seen that assembled containers 54 are configured to be easily stackable by aligning the containers so that the stacking tabs of a lower container are received by stacking slots 52 of an upper container.

It should be appreciated from the foregoing description that the present invention provides a stackable container formed from a single-piece blank pre-cut and pre-scored with an improved design directed at providing material cost savings while achieving stacking stability and related benefits. This is achieved, in part, by providing two-ply stacking tabs configured to extend beyond the shoulder joints of two-ply walls configured with inner and outer panels, wherein the stacking tabs are formed from material which would otherwise be part of the inner panels. Thus, providing the benefits of stacking tabs and two-ply walls without expanding size requirements of the blank.

While a particular form of the invention has been illustrated and described, it will be apparent that various modifications can be made without departing from the invention. Accordingly, the invention is to be defined only by the following claims.

I claim:

1. A container formed from a single blank, the container comprising:

a base with a set of opposing edges;

a first set of opposing walls, each opposing wall of the first set having, a first panel with a lower edge and an upper edge, foldably attached at the lower edge to the base, a second panel, having an upper edge, hinged to the first panel at their respective upper edges, the two upper edges defining a shoulder, and a plurality of shoulder hinges for hinging the first panel and the second panel at the shoulder, each shoulder hinge formed by two spaced-apart cut lines oriented generally perpendicular to the shoulder, wherein at least one of the spaced-apart cut lines has a shoulder cut line extending from its mid-point and positioned along the shoulder, and at least one stacking tab, extending above the shoulder, having a tab base and a sequencing panel, wherein the tab base extends from the first panel and is foldably attached to the sequencing panel, and wherein the tab base and the sequencing panel are formed from material cut from the second panel; and a second set of opposing walls attached to the base substantially perpendicular to the first set of opposing walls.

2. A container as defined in claim 1, wherein the base has two opposing side edges and two opposing end edges, wherein the first panels are foldably attached to the side edges.

3. A container as defined in claim 1, wherein the base has two opposing side edges and two opposing end edges, wherein the first panels are foldably attached to the end edges.

4. A container as defined in claim 1, wherein each of the spaced-apart cut lines forming the plurality of shoulder hinges has a shoulder cut line extending from its mid-point and positioned along the shoulder.

5. A container as defined in claim 4, wherein each first panel is foldably attached to the base by a single fold line.

6. A container as defined in claim 4, wherein each wall of the first set of opposing walls has a two-ply thickness.

7. A container as defined in claim 6 wherein:

the container is formed from corrugated paperboard; and the corrugation lines within the first set of opposing walls are substantially perpendicular to the base.

8. A container as defined in claim 1, wherein each wall of the second set of opposing walls has a three-ply thickness.

9. A container as defined in claim 8, wherein each wall of the first set of opposing walls has a two-ply thickness.

10. A container formed from a single blank, the container comprising:

a base having opposing side edges and opposing end edges;

two side walls, each side wall having a first panel with a lower edge, an upper edge, and two opposing side edges, attached at the lower edge to one of the opposing side edges of the base by a fold line, a second panel with two opposing side edges, hinged to the upper edge of the first side panel, the upper edge defining a shoulder, a plurality of shoulder hinges for hinging the first panel and the second panel at the shoulder, each shoulder hinge formed by two spaced-apart cut lines oriented generally perpendicular to the shoulder, wherein at least one of the spaced-apart cut lines has a shoulder cut line extending from its mid-point and positioned along the shoulder, and at least one stacking tab, extending beyond the shoulder, having a tab base and a sequencing panel, wherein the tab base extends from the first panel and is foldably attached to the sequencing panel, and wherein the tab base and sequencing panel are formed from material cut from the second panel; and two end walls, each end wall having an outer end panel with a lower edge, attached to one of the opposing end edges of the base by a fold line, two center flaps each attached to one of the opposing side edges of the first panel by a fold line, and two inner flaps each attached to one of the opposing side edges of the second panel by a fold line.

11. A container as defined in claim 10, wherein the side walls have a three-ply thickness.

12. A container as defined in claim 10, wherein the end walls have a two-ply thickness.

13. A container as defined in claim 10, wherein the container is formed from corrugated paperboard, wherein the corrugation lines within the side walls are substantially perpendicular to the base.

14. A container as defined in claim 10, wherein each of the spaced-apart cut lines forming the plurality of shoulder hinges has a shoulder cut line extending from its mid-point and positioned along the shoulder.

15. A container formed from a single blank, the container comprising:

a rectangular base;

a first wall having, a first panel with a lower edge and an upper edge, foldably attached at the lower edge to the base, a second panel, having an upper edge, hinged to the first panel at their respective upper edges, the two upper edges defining a shoulder, a shoulder hinge for hinging the first panel and the second panel at the shoulder, formed by two spaced-apart cut lines oriented generally perpendicular to the shoulder, wherein at least one of the spaced-apart cut lines has a shoulder cut line extending from its mid-point and positioned along the shoulder, and at least one stacking tab, extending above the shoulder, having a tab base and a sequencing panel, wherein the tab base extends from the first panel and is foldably attached to the sequencing panel, and wherein the tab base and the sequencing panel are formed from material cut from the second panel;

a second wall foldably attached to the base and opposing the first wall;

a third wall foldably attached to the base substantially perpendicular to both the first wall and the second wall; and a fourth wall foldably attached to the base opposing the third wall and substantially perpendicular to both the first wall and the second wall.

16. A container as defined in claim 15, wherein the first wall has a two-ply thickness.

17. A container as defined in claim 16, further comprising a plurality of shoulder hinges.

18. A container as defined in claim 17, wherein each of the spaced-apart cut lines forming the plurality of shoulder hinges has a shoulder cut line extending from its mid-point and positioned along the shoulder.

* * * * *